US010802425B2

(12) United States Patent
Kato

(10) Patent No.: US 10,802,425 B2
(45) Date of Patent: Oct. 13, 2020

(54) IMAGE FORMING APPARATUS

(71) Applicant: CANON KABUSHIKI KAISHA, Tokyo (JP)

(72) Inventor: Wataru Kato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/724,933

(22) Filed: Dec. 23, 2019

(65) Prior Publication Data

US 2020/0209786 A1 Jul. 2, 2020

(30) Foreign Application Priority Data

Dec. 28, 2018 (JP) ..... 2018-246430

(51) Int. Cl.
*G03G 15/16* (2006.01)
*G03G 15/00* (2006.01)

(52) U.S. Cl.
CPC ..... *G03G 15/1675* (2013.01); *G03G 15/553* (2013.01)

(58) Field of Classification Search
CPC ... G03G 15/1675; G03G 15/553; G03G 15/55
See application file for complete search history.

(56) References Cited

U.S. PATENT DOCUMENTS

2004/0114947 A1* 6/2004 Geleynse ..... G03G 15/14 399/31
2005/0163516 A1* 7/2005 Eom ..... G03G 15/55 399/12

FOREIGN PATENT DOCUMENTS

JP 09-304997 A 11/1997
JP 11-109827 A 4/1999
JP 2006-227520 A 8/2006

* cited by examiner

*Primary Examiner* — Sandra Brase
(74) *Attorney, Agent, or Firm* — Venable LLP

(57) ABSTRACT

An image forming apparatus includes an endless belt, a rotary member configured to transfer the toner image on the belt to the recording material, a power supply configured to apply transfer voltage to the rotary member to transfer the toner image on the belt to the recording material, an acquisition unit configured to acquire each value related to the number of recording materials passing through each area of the belt divided into a plurality of areas in a width direction of the belt, and an output unit configured to output error information related to a life of the belt based on each value.

9 Claims, 10 Drawing Sheets

IMAGE FORMING APPARATUS

BACKGROUND OF THE INVENTION

Field of the Invention

The present invention relates to an image forming apparatus that adopts an electrophotographic technique, such as a printer, a copying machine, a facsimile machine or a multifunction machine.

Description of the Related Art

An intermediate transfer-type image forming apparatus is known as an example of an image forming apparatus, in which a toner image formed on a photosensitive drum is primarily transferred to an intermediate transfer belt, and then the toner image primarily transferred to the intermediate transfer belt is secondarily transferred to a recording material at a transfer nip portion formed for transferring image. Another example is a direct transfer-type image forming apparatus in which toner image formed on a photosensitive drum is directly transferred from a photosensitive drum to a recording material conveyed on a conveyor belt. The intermediate transfer belt and the conveyor belt used in these image forming apparatuses are physically deteriorated by use, so that they are arranged in a replaceable manner in the apparatus body. Hitherto, a notice for notifying replacement of the belt is output to the user based on an accumulated number of sheets of recording material to which image has been formed or a distance of travel of the belt, and so on.

Further, if the intermediate transfer belt and the conveyor belt are formed of resin, electric resistance on the belt surface, hereinafter referred to as surface resistivity, may be deteriorated by discharge caused at the transfer nip portion during transfer, which could be described as electric deterioration as opposed to physical deterioration. The belt having deteriorated surface resistivity may cause transfer defects, so that it must be replaced. Japanese Patent Application Laid-Open Publication No. 2006-227520 discloses measuring the electric resistance of the belt and notifying the user to replace the belt.

Deterioration of surface resistivity of the belt described above tends to occur at an area of the belt that contacts the recording material, hereinafter referred to as sheet passing area for convenience. That is, the surface resistivity of the belt is easily deteriorated at the sheet passing area and not easily deteriorated at a non-sheet passing area where the belt does not contact the recording material. Therefore, if transfer of image is performed to a recording material having a long length in a main scanning direction after transfer of image is performed to a large number of recording materials having a short size in the main scanning direction, image defects may be caused where a step-like difference appears in the image density caused by the surface resistivity of the belt being varied in the main scanning direction. Therefore, it is desirable to notify the user of the need to replace the belt before such image defects caused by reduction of surface resistivity in the main scanning direction, i.e., width direction, of the belt occur. However, in a case according to the conventional art where replacement of the belt is notified based on accumulated number of sheets of recording material or based on travelling distance of the belt, there was a risk that the above-described image defects have already occurred before notifying replacement of the belt. In the case of the apparatus disclosed in Japanese Patent Application Laid-Open Publication No. 2006-227520 described above, it is difficult to detect electric resistance at different locations of the belt. Further, the resistance of the belt may increase with use, depending on the material of the belt. For example, in the case of a belt containing an ionic conductive agent, resistance may be increased by repeated electric conduction. Therefore, similar problems may occur.

SUMMARY OF THE INVENTION

In view of the problems mentioned above, the present invention provides an image forming apparatus capable of notifying to the user information related to life of the belt, considering the level difference of surface resistivity in a width direction of the belt that may occur when transfer of image is performed to small-sized recording materials.

According to a first aspect of the present invention, an image forming apparatus includes an endless belt configured to rotate and bear a toner image, a rotary member configured to transfer the toner image on the belt to a recording material, a power supply configured to apply transfer voltage to the rotary member to transfer the toner image on the belt to the recording material, an acquisition unit configured to acquire each value related to the number of recording materials passing through each area of the belt divided into a plurality of areas in a width direction of the belt, and an output unit configured to output error information related to a life of the belt based on each value.

According to a second aspect of the present invention, an image forming apparatus includes an endless belt configured to rotate and bear a toner image, a rotary member configured to transfer the toner image on the belt to a recording material at a transfer nip portion, a power supply configured to apply transfer voltage to transfer the toner image on the belt to the recording material, and an output unit configured to output error information related to a life of the belt based on a size in a width direction of the recording materials passing through the transfer nip portion and a value related to the number of recording materials passing through the transfer nip portion. In case that images are continuously formed on a plurality of first recording materials having a maximum size in the width direction of the belt, the output unit outputs the error information of the belt when the number of recording materials passing through the transfer nip portion reaches a first number, and in case that images are continuously formed on a plurality of a second recording materials having a predetermined size smaller than the maximum size in the width direction, the output unit outputs the error information of the belt when the number of recording materials passing through the transfer nip portion reaches a second number smaller than the first number.

Further features of the present invention will become apparent from the following description of exemplary embodiments with reference to the attached drawings.

DESCRIPTION OF THE EMBODIMENTS

First Embodiment

Image Forming Apparatus

Figure 1:
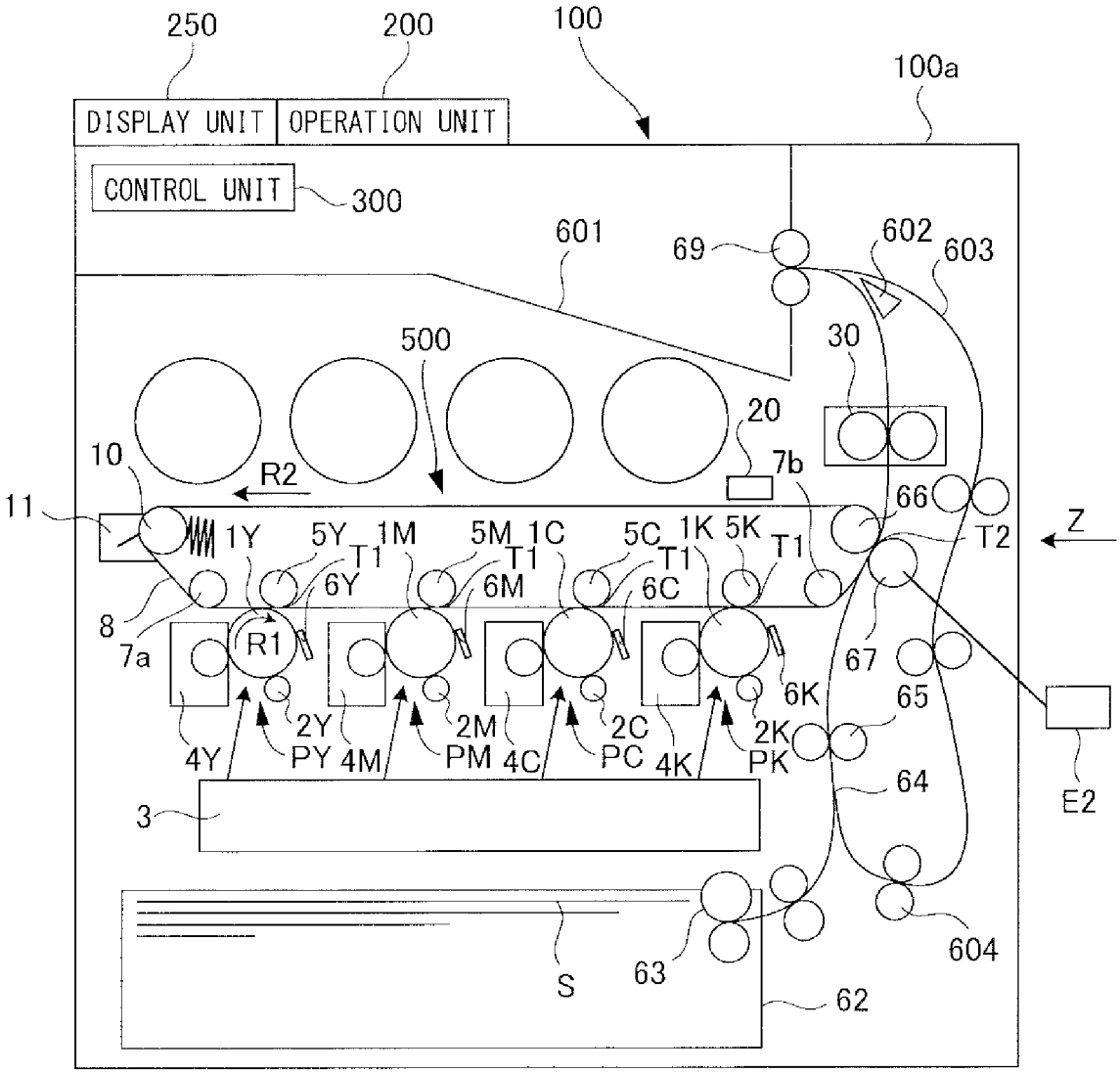
FIG. 1 is a schematic drawing illustrating a configuration of an image forming apparatus according to the present embodiment.

A first embodiment will be described. At first, an image forming apparatus according to the present embodiment will be described with reference to FIG. 1. An image forming apparatus 100 illustrated in FIG. 1 is a tandem intermediate transfer-type color image forming apparatus in which image forming units PY, PM, PC and PK of four colors, which are yellow, cyan, magenta and black, are arranged opposed to an intermediate transfer belt 8 in an apparatus body 100*a*.

A conveyance process of recording materials in the image forming apparatus 100 will be described. A recording material S is stored in a manner stacked in a cassette 62 and fed one at a time to a conveyance path 64 by a sheet feed roller 63 at a timing matching the image forming timing. It is also possible to feed a recording material S stacked in a manual feed tray or a recording material stacking apparatus (not shown) one at a time to the conveyance path 64. In a state where the recording material S is conveyed to a registration roller 65 arranged midway of the conveyance path 64, the recording material S is subjected to skew correction and timing correction by the registration roller 65, before the sheet S is sent to a secondary transfer portion T2. The secondary transfer portion T2 is a transfer nip portion formed by a secondary transfer inner roller 66 and a secondary transfer outer roller 67, which are opposed to one another. The recording material S is nipped and conveyed at the secondary transfer portion T2 between the intermediate transfer belt 8. In that state, if secondary transfer voltage is applied to the secondary transfer outer roller 67 serving as a rotary member by a secondary transfer power supply E2, the toner image is secondarily transferred from the intermediate transfer belt 8 to the recording material S. In the present embodiment, the secondary transfer inner roller 66 is electrically grounded, that is, connected to ground. The present configuration is not limited to this example, and it is possible to ground the secondary transfer outer roller 67 and apply a secondary transfer voltage to the secondary transfer inner roller 66.

With respect to the conveyance processing of the recording material S to the secondary transfer portion T2 described above, a process for forming an image sent to the secondary transfer portion T2 at a similar timing will be described. At first, image forming units PY to PK will be described. The image forming units PY to PK adopt a similar configuration, except for the difference in the colors of the toner used in the respective developing units 4Y, 4M, 4C and 4K, which are yellow, magenta, cyan and black. A yellow image forming unit PY will be described as an example in the following description, and descriptions of other image forming units PM, PC and PK will be omitted.

Image Forming Unit

Figure 2:
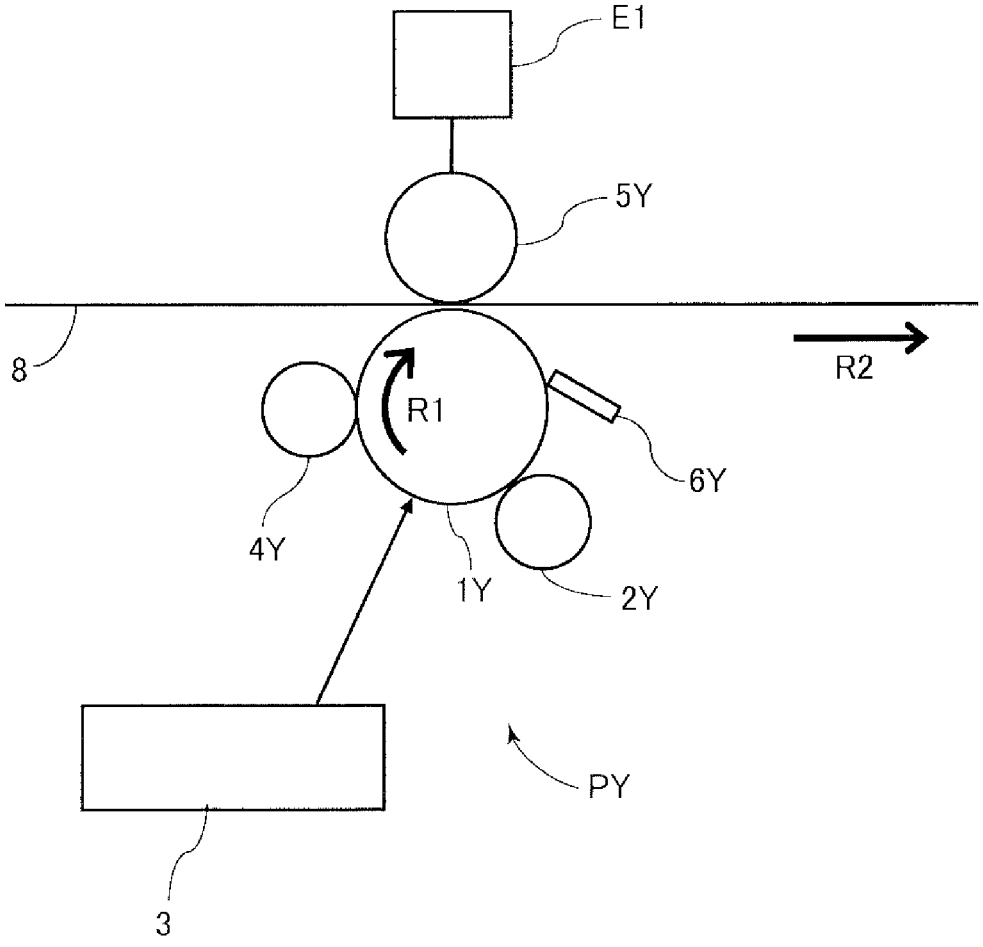
FIG. 2 is a schematic drawing illustrating an image forming unit.

As illustrated in FIG. 2, a charging unit 2Y, a developing unit 4Y, a primary transfer roller 5Y and a drum cleaning device 6Y are arranged around a photosensitive drum 1Y in the image forming unit PY. The photosensitive drum 1Y serving as an image bearing member is a drum-shaped electrophotographic photosensitive member that is supported rotatably on the apparatus body 100*a*, and it is rotated in a clockwise direction (direction of arrow R1 in the drawing) at a predetermined processing speed by a photosensitive drum drive motor not shown. The surface of the photosensitive drum 1Y driven to rotate is charged uniformly in advance by the charging unit 2Y, and thereafter, an electrostatic latent image is formed thereon by an exposing unit 3 driven based on an image information signal Next, the electrostatic latent image formed on the photosensitive drum 1Y is visualized through toner development by the developing unit 4Y. Thereafter, predetermined pressure and primary transfer bias is applied by the primary transfer roller 5Y, and the toner image formed on the photosensitive drum 1Y is primarily transferred to the intermediate transfer belt 8. That is, the primary transfer roller 5Y is arranged opposed to the photosensitive drum 1Y interposing the intermediate transfer belt 8, and a primary transfer portion T1 of toner image is formed between the photosensitive drum 1Y and the intermediate transfer belt 8. At the primary transfer portion T1, a primary transfer voltage is applied to the primary transfer roller 5Y, by which the toner image is primarily transferred from the photosensitive drum 1Y to the intermediate transfer belt 8. The transfer residual toner that slightly remains on the photosensitive drum 1Y after primary transfer is removed by the drum cleaning device 6Y, and the apparatus prepares for the subsequent image forming process.

The above-described image forming processes performed by the image forming units PY to PK are performed at such timings so that the image is overlapped sequentially to color toner images that have already been primarily transferred to the intermediate transfer belt 8 upstream in the direction of rotation of the intermediate transfer belt 8. As a result, a full-color toner image is finally formed on the intermediate transfer belt 8 and conveyed to the secondary transfer portion T2. Transfer residual toner having passed the secondary transfer portion T2 is removed from the intermediate transfer belt 8 by a transfer cleaner device 11. According to the image forming apparatus 100 of the present embodiment, in addition to forming a full-color toner image on the intermediate transfer belt 8, i.e., full-color mode, a black toner image can be formed on the intermediate transfer belt 8 using only the image forming unit PK, i.e., mono-color mode.

By the conveyance process and the image forming process respectively described above, the recording material S and the full-color toner image arrive at the secondary transfer portion T2 at a matched timing, and the toner image is secondarily transferred from the intermediate transfer belt 8 to the recording material S. Thereafter, the recording material S is conveyed to a fixing unit 30, where pressure and heat are applied by the fixing unit 30 and the toner image is melted and fixed to the recording material S. The recording material S to which the toner image has been fixed is discharged by a sheet discharge roller 69 onto a sheet discharge tray 601.

According to the present embodiment, a resin belt formed by dispersing conductive agent such as carbon black in resin such as polyimide (PI) or polyether ether ketone (PEEK) and forming the same into an endless belt shape is used as the intermediate transfer belt 8 serving as a belt member. The intermediate transfer belt 8 can also be an ion-conductive type containing an agent having ionic conductivity, for example. The intermediate transfer belt 8 is stretched across a tension roller 10, a secondary transfer inner roller 66 and idler rollers 7*a* and 7*b*, and driven to move in the direction of arrow R2 in the drawing. According to the present embodiment, the secondary transfer inner roller 66 serves as a drive roller for driving the intermediate transfer belt 8. The primary transfer roller 5Y includes a core metal and an elastic layer formed around the core metal. The elastic layer of the primary transfer roller 5Y is formed of a foamed sponge having ionic conductivity including, for example, nitrile rubber (NBR) and hydrin rubber (CO), for example. The secondary transfer inner roller 66 includes a core metal, and an elastic layer formed of rubber such as ethylene-propylene-diene rubber (EPDM) surrounding the core metal. The secondary transfer outer roller 67 includes a core metal, and an elastic layer formed of rubber such as NBR and EPDM surrounding the core metal.

In the case of the present embodiment, the above-described primary transfer rollers 5Y to 5K, the intermediate transfer belt 8, the tension roller 10, the idler rollers 7*a* and 7*b* and the secondary transfer inner roller 66 are formed integrally as an intermediate transfer belt unit 500 (hereinafter simply referred to as belt unit). The belt unit 500 is detachably attached to the apparatus body 100*a*. That is, the intermediate transfer belt 8 and the secondary transfer inner roller 66 are easily deteriorated through use and they have a shorter duration life than other parts so that they must be replaced. In order to improve the replacement property thereof, they are formed as the belt unit 500 that can be easily removed from the apparatus body 100*a*. Although not shown, an insertion opening (not shown) through which the belt unit 500 can be attached and detached is formed on the apparatus body 100*a*. The direction of insertion of the belt unit 500 to the apparatus body 100*a* is, for example, a direction of insertion of the secondary transfer inner roller 66 in the rotational axis direction, i.e., direction of arrow Z in the drawing.

The image forming apparatus 100 according to the present embodiment may be able to form images on both sides of the recording material S. That is, the apparatus can execute a one-side printing mode in which image is formed only to one side of the recording material S, and a duplex printing mode in which image is formed to both sides of the recording material S. The conveyance destination of the sheet after fixing the toner image on a first side, i.e., upper side, differs between the one-side printing mode and the duplex printing mode. According to the one-side printing mode, the recording material S having the toner image formed on a first side is discharged onto the sheet discharge tray 601 by the sheet discharge roller 69 rotating in normal rotation. Meanwhile, in the case of the duplex printing mode, the recording material S having the toner image formed on the first side is conveyed until a trailing edge of the recording material S passes a switching member 602 by the sheet discharge roller 69 rotated in normal rotation. Thereafter, leading and trailing edges are reversed by the sheet discharge roller 69 rotated in reverse rotation, and the sheet is conveyed to a duplex conveyance path 603. Thereafter, the sheet is sent again to the conveyance path 64 by a sheet reconveyance roller 604. The conveyance performed thereafter and an image forming process performed to a second side of the sheet is similar to that described above, so that detailed descriptions thereof are omitted.

Control Unit

As shown in FIG. 1, the image forming apparatus 100 includes a control unit 300. The control unit 300 will be described with reference to FIG. 3. In addition to members illustrated in FIG. 3, various motors for driving the photosensitive drums 1Y to 1K and the secondary transfer inner roller 66 and various devices such as a primary transfer power supply for applying voltage to the primary transfer rollers 5Y to 5K and the fixing unit 30, which are not shown, are connected to the control unit 300. However, since such members are not related to the main object of the present invention, illustrations and descriptions thereof are omitted.

The control unit 300 serving as an output unit includes, for example, a CPU (Central Processing Unit) 301 that performs image forming operation and other various controls of the present image forming apparatus 100, and a memory 302. The memory 302 serving as storage is composed, for example, of ROM (Read Only Memory) and RAM (Random Access Memory), and various programs for controlling the image forming apparatus 100 and various data such as tables are stored therein. The CPU 301 can execute an image forming job (program) stored in the memory 302 and operate the image forming apparatus 100 to perform image forming. In the present embodiment, the CPU 301 is capable of executing a "replacement notification processing (program)" (refer to FIG. 5 described later) stored in the memory 302. Further, the CPU 301 functions as a counter for counting the number of sheets of the recording material S to which image has been formed, and stores the counted number in the memory 302. The memory 302 is capable of temporarily storing the result of calculation processing accompanying the execution of various programs, for example.

The image forming apparatus 100 according to the present embodiment includes an operation unit 200 and a display unit 250 (refer to FIG. 1), and the operation unit 200 and the display unit 250 are connected via an input-output interface to the control unit 300. The operation unit 200 is an external terminal or an operation panel, such as a scanner or a personal computer, having a physical operator for receiving instructions to start execution of various programs such as the image forming job from the user or input of various data. In the case of the present embodiment, the user can input the size, i.e., sheet type such as A4 or B5, of the recording material S to which image is to be formed using the operation unit 200. Further, the user can instruct execution of a duplex printing mode for forming an image on both sides of the recording material S, or a one-side printing mode for forming an image on only one side of the recording material S. Further, the user can instruct execution of a full-color mode in which toner image of multiple colors is formed using a combination of yellow, magenta, cyan and black, or a single-color mode in which toner image using only black is formed. In a state where starting of an image forming job of one of the printing modes is instructed from the operation unit 200, the control unit 300 executes an image forming job (program) stored in the memory based on image data entered from the operation unit 200. The control unit 300 can control the operation of the image forming apparatus 100 based on the execution of the image forming job.

The display unit 250 serving as a notification unit is, for example, a liquid crystal display or an external display that is capable of displaying error of image forming operation, notification of replacement of the intermediate transfer belt 8, and menus presenting various programs that can be executed by the user. In the case of the present embodiment, in order to notify the user to replace the intermediate transfer belt 8, the notification can be performed not only by displaying on the display unit 250 but also by flashing light using LED or by generating a sound from a speaker, for example. It is also possible to display a virtual operator that looks like a physical operator on the display unit 250 by the control unit 300, and to receive execution start operation of various programs by the user or input operation of various data through the virtual operator.

Further, an environment sensor 20 is connected to the control unit 300 via an input-output interface. The environment sensor 20 serving as a temperature detecting unit is arranged in the apparatus body 100*a* (refer to FIG. 1), and as described in detail later, it can detect humidity that may influence the surface resistivity of the intermediate transfer belt 8. The control unit 300 can acquire humidity detected by the environment sensor 20. The environment sensor 20 can detect not only humidity but also temperature.

Reduction of Surface Resistivity

In a state where the intermediate transfer belt 8 formed of resin is used, the surface resistivity of the intermediate transfer belt 8 may be reduced gradually by forming images to a large number of recording materials S. This is due to the following reasons. During transfer of image at the secondary transfer portion T2, micro discharge occurs between the recording material S and the intermediate transfer belt 8, or charge transfer occurs from the recording material S to the intermediate transfer belt 8, by which conductive agent particles (referred to as conductive particles) are charged on the surface side of the belt. In the intermediate transfer belt 8, electric filed occurs locally between charged conductive particles and other conductive particles nearby, and if the electric field is intense, discharge occurs between multiple conductive particles, causing resin contained in the intermediate transfer belt 8 to partially decompose and carbonize by the heat caused by the discharge. Carbonated resin loses its insulation and serves as a conductor. As the image transfer operation is performed repeatedly, the areas in which insulation breakdown occurs is increased, so that the surface resistivity of the intermediate transfer belt 8 is gradually reduced.

Figure 4:
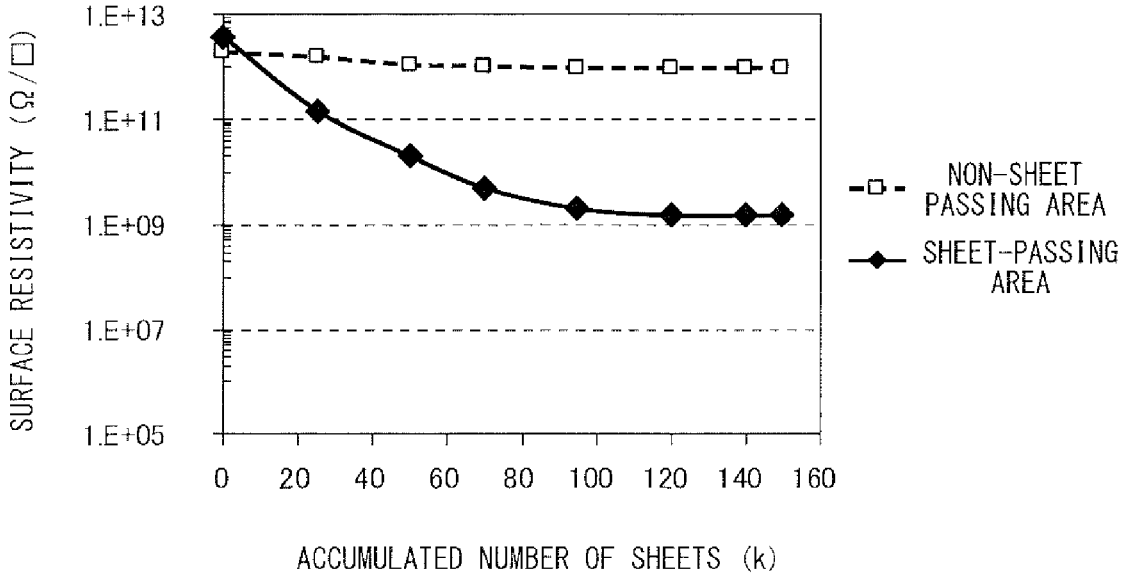
FIG. 4 is a graph illustrating a relationship between accumulated number of sheets and surface resistivity of belt.

We will describe an actual example with reference to FIG. 4. FIG. 4 is a graph illustrating a relationship between the accumulated number of sheets of the recording material S and the surface resistivity of the intermediate transfer belt 8 in a state after conveying A4-sized sheets in a vertical direction (A4 vertical) as the recording material S and continuously forming images thereto. In FIG. 4, the solid line represents the surface resistivity of a sheet passing area of the intermediate transfer belt 8 that contacts the recording material S, and the dotted line represents the surface resistivity of a non-sheet passing area of the intermediate transfer belt 8 that does not contact the recording material S.

As illustrated in FIG. 4, the surface resistivity of the sheet passing area is gradually reduced as the accumulated number of sheets of the recording material S increases, and in a state where the accumulated number of sheets exceeds "100 k", the surface resistivity is converged to approximately "5.0 E+9Ω/□". It is considered that the area in which discharge occurs between multiple conductive particles is limited regarding the width direction of the intermediate transfer belt 8 intersecting the rotation direction, that is, the main scanning direction of the recording material S, and after insulation breakdown by discharge ends at that location, no more insulation breakdown occurs. Meanwhile, in the non-sheet passing area, discharge does not occur and breakdown is not caused, so that the surface resistivity of the non-sheet passing area is approximately unchanged even if the accumulated number of sheets of the recording material S is increased.

In the above-described state where the surface resistivity differs between the A4-sized sheet passing area and the non-sheet passing area by forming images to A 4-sized recording materials S, if forming of image is performed to a B4-sized recording material S that is greater than the A4-size, density difference occurs to the image in the width direction of the intermediate transfer belt 8. That is, during forming of image to the B4-sized recording material S, primary transfer voltage is applied to the primary transfer rollers 5Y to 5K for primarily transferring the toner image formed on the photosensitive drums 1Y to 1K to the intermediate transfer belt 8. In that state, primary transfer voltage is constant in the width direction of the intermediate transfer belt 8, but primary transfer current may vary in the width direction according to the surface resistivity of the intermediate transfer belt 8. In that case, charge potential is increased at the sheet passing area of the intermediate transfer belt 8, so that separation discharge tends to occur when passing the primary transfer portion T1 in the sheet passing area. When separation discharge occurs, reverse transfer where a part of the toner image temporarily transferred to the intermediate transfer belt 8 is transferred again to the photosensitive drums 1Y to 1K occurs. As a result, during forming of image to the B4-sized recording material S, the primary transfer efficiency is reduced at the A4-sized sheet passing area, and image defects may occur where image density differs between the A4-sized sheet passing area and the A4-sized sheet non-passing area.

As described, since the surface resistivity of the intermediate transfer belt 8 is reduced according to use and image defects are caused thereby, the intermediate transfer belt 8 must be replaced. As already described, conventionally, belt replacement was notified based on the accumulated number of sheets of the recording material S or the travelling distance of the intermediate transfer belt 8. However, according to the conventional technique, in many cases, image defects caused by reduction of surface resistivity of the intermediate transfer belt 8 had already occurred. In other words, the timing for notifying of belt replacement tended to be delayed. According to another conventional technique, the surface resistivity of the intermediate transfer belt 8 was measured, and based thereon, notification of belt replacement was issued to the user, but it was difficult to detect surface resistivities at different areas of the sheet passing area and the non-sheet passing area. In view of the above-described points, the present embodiment enables to notify of belt replacement to the user easily before image defects caused by reduction of surface resistivity of the intermediate transfer belt 8 occur. The present embodiment will be described hereafter.

Replacement Notification Processing

Figure 3:
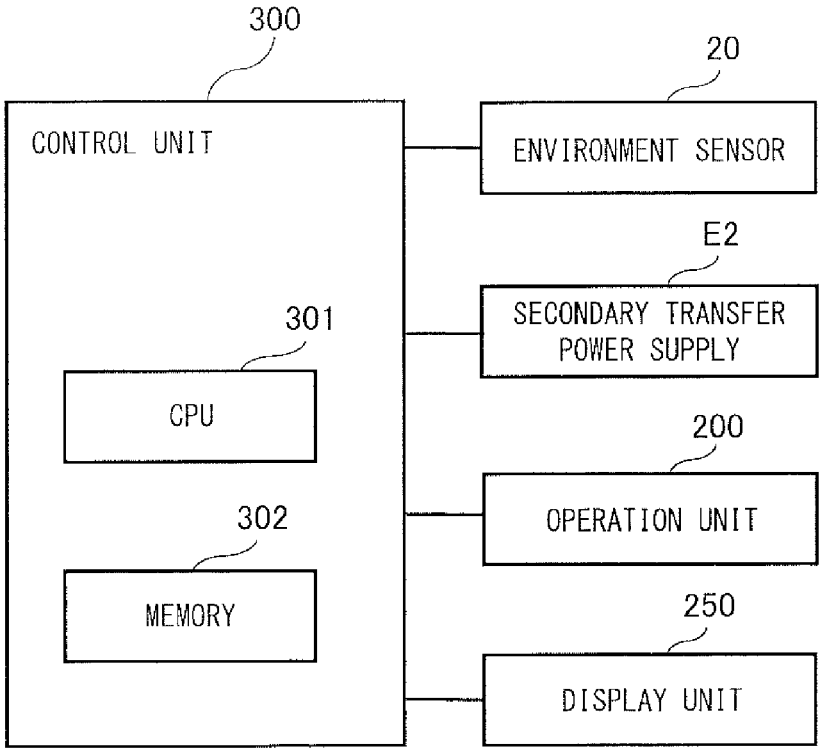
FIG. 3 is a control block diagram illustrating a control unit.
Figure 5:
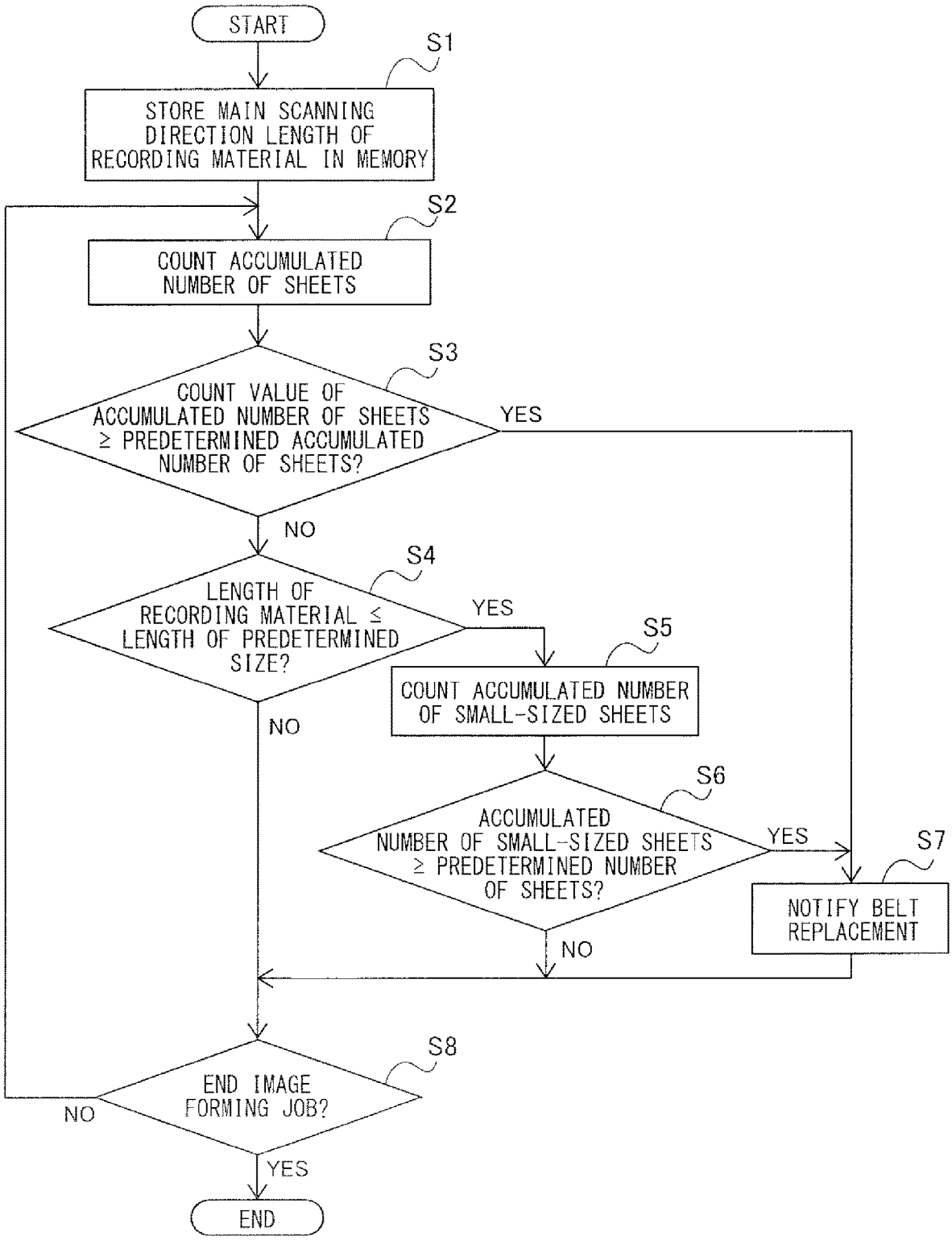
FIG. 5 is a flowchart illustrating a replacement notification processing according to a first embodiment.

A replacement notification processing according to a first embodiment will be described based on FIG. 5 with reference to FIG. 3. The replacement notification processing is started by the control unit 300 at a matched timing with the execution of an image forming job. As illustrated in FIG. 5, the control unit 300 stores a main scanning direction length, that is, the width-direction length in the intermediate transfer belt 8 of the recording material S in the memory 302 (S1). The main scanning direction length of the recording material S is, for example, a length determined by the sheet type, i.e., size, of the recording material S entered by the user through the operation unit 200. For example, in forming an image by conveying the recording material S in a vertical direction, the main scanning direction length of "A4" is "210 mm", and the main scanning direction length of "B4" is "257 mm". Regardless of the size of the recording material S, the control unit 300 counts the value of accumulated number of sheets each time image is formed to one sheet of recording material S (S2). In the present embodiment, size conversion is performed to the counted number of sheets. That is, if the recording material S has a sub-scanning direction length of the recording material S that is greater than the short direction length (210 mm) of the "A4" sheet, the control unit 300 adds "+2" to the count value of accumulated number of sheets. Meanwhile, in the case of a small-sized recording material S whose sub-scanning direction length is smaller than the short direction length of "A4", the control unit 300 adds "+1" to the count value of accumulated number of sheets. The control unit 300 stores the count value of accumulated number of sheets in the memory 302.

The control unit 300 determines whether the count value of accumulated number of sheets is greater than a predetermined accumulated number of sheets, which is a second number of sheets, such as "150 k" or greater (S3). If the count value of accumulated number of sheets is equal to or greater than the predetermined accumulated number of sheets, that is, if the predetermined accumulated number of sheets had been reached (S3: YES), the control unit 300 outputs error information and notifies of belt replacement to the user (S7). For example, under the control performed by the control unit 300, the display unit 250 can display a notification to perform belt replacement based on the error information. That is, according to the present embodiment, the life determined by physical deterioration by use of the intermediate transfer belt 8 is set to approximately the "150 k" number of accumulated sheets of the recording material S.

If the count value of accumulated number of sheets is smaller than a predetermined accumulated number of sheets (S3: NO), the control unit 300 determines whether the main scanning direction length of the recording material S is smaller than a short direction length of a predetermined size, such as "210 mm" of A4 sheet (S4). If the main scanning direction length of the recording material S is of a large-sized recording material S serving as a second recording material which is greater than a short direction length of a predetermined size (S4: NO), the control unit 300 jumps to the process of step S8. Meanwhile, if the main scanning direction length of the recording material S is of a small-sized recording material S serving as a first recording material which is smaller than the short direction length of the predetermined size (S4: YES), the control unit 300 counts the accumulated number of small-sized sheets as information correlated with the number of passed sheets (S5). The control unit 300 stores the counted accumulated number of small-sized sheets in the memory 302. The count value of accumulated number of sheets and the accumulated number of small-sized sheets described above are cleared when the intermediate transfer belt 8 is replaced with a new one, and the value is set to an initial value "0".

The control unit 300 determines whether the accumulated number of small-sized sheets is equal to or greater than a predetermined number of sheets, i.e., first number of sheets, such as "70 k" or greater (S6). If the accumulated number of small-sized sheets is smaller than the predetermined number of sheets (S6: NO), the control unit 300 advances to the processing of step S8. Meanwhile, if the accumulated number of small-sized sheets is equal to or greater than the predetermined number of sheets, that is, if the number has reached the predetermined number of sheets (S6: YES), the control unit 300 notifies of belt replacement to the user (S7). The control unit 300 causes the display unit 250 to display a message to replace the belt. In other words, end of life due to electric deterioration in which the difference in surface resistivity of the intermediate transfer belt 8 causes image defects is set to approximately "70 k" of accumulated number of sheets of the small-sized recording material S. It has been confirmed by experiments carried out by the present inventors that according to the present embodiment, end of life due to electric deterioration of the intermediate transfer belt 8 occurred in a case where the difference between the surface resistivity of the sheet passing area and the surface resistivity of the non-sheet passing area becomes one digit or greater. This is the case where the accumulated number of sheets of the small-sized recording material S has reached "70 k" or greater, and in view thereof, the threshold value of the accumulated number of small-sized sheets is set to "70 k" sheets.

As a processing of step S8, the control unit 300 determines whether the image forming job has been completed. If the image forming job has been completed (S8: YES), the control unit 300 ends the replacement notification processing. If the image forming job is not completed (S8: NO), the control unit 300 returns to the process of step S2 and repeats the processing of steps S2 to S8.

As described, according to the present embodiment, if the accumulated number of sheets of the large-sized recording material S and the small-sized recording material S having passed the secondary transfer portion T2 along with the execution of the image forming job has reached the second number of sheets, the control unit 300 outputs error information and notifies the user to replace the belt. Further, if the accumulated number of sheets of only the small-sized recording material S has reached the first number of sheets before the accumulated number of sheets of the large-sized recording material S and the small-sized recording material S reaches the second number of sheets, the control unit 300 outputs error information, and notifies the user to replace the belt. This first number of sheets serving as the threshold value is set smaller than the second number of sheets. As described, according to the present embodiment, notification to replace the belt is output based on the accumulated number of sheets of only the small-sized recording material S. That is, if only a first recording material, whose length in the width direction intersecting the rotation direction of the belt 8 is a first length, is passed through, the control unit 300 as the output unit outputs the error information of the belt when the number of sheets of recording material passing through the transfer nip portion T2 reaches at the first number of sheets, and if only a second recording material, whose length in the width direction is a second length that is greater than the first length, is passed through, the control unit 300 outputs the error information of the belt 8 when the number of sheets of recording material passing through the transfer nip portion T2 reaches at the second number of sheets that is greater than the first number of sheets. In a case that images are continuously formed on a plurality of first recording materials having a maximum size among usable sheet sizes of the image forming apparatus, the control unit 300 outputs the error information of the belt when the number of recording materials passing through the transfer nip portion reaches a first number, and in case that images are continuously formed on a plurality of a second recording materials having a predetermined size smaller than the maximum size in the width direction, the control unit 300 outputs the error information of the belt when the number of sheets of recording material passing through the transfer nip portion reaches a second number smaller than the first number. Thereby, it becomes possible to notify the user to replace the intermediate transfer belt 8 before image defects caused by reduction of surface resistivity of the intermediate transfer belt 8 caused by contact with the recording material S occur.

Second Embodiment

Figure 6:
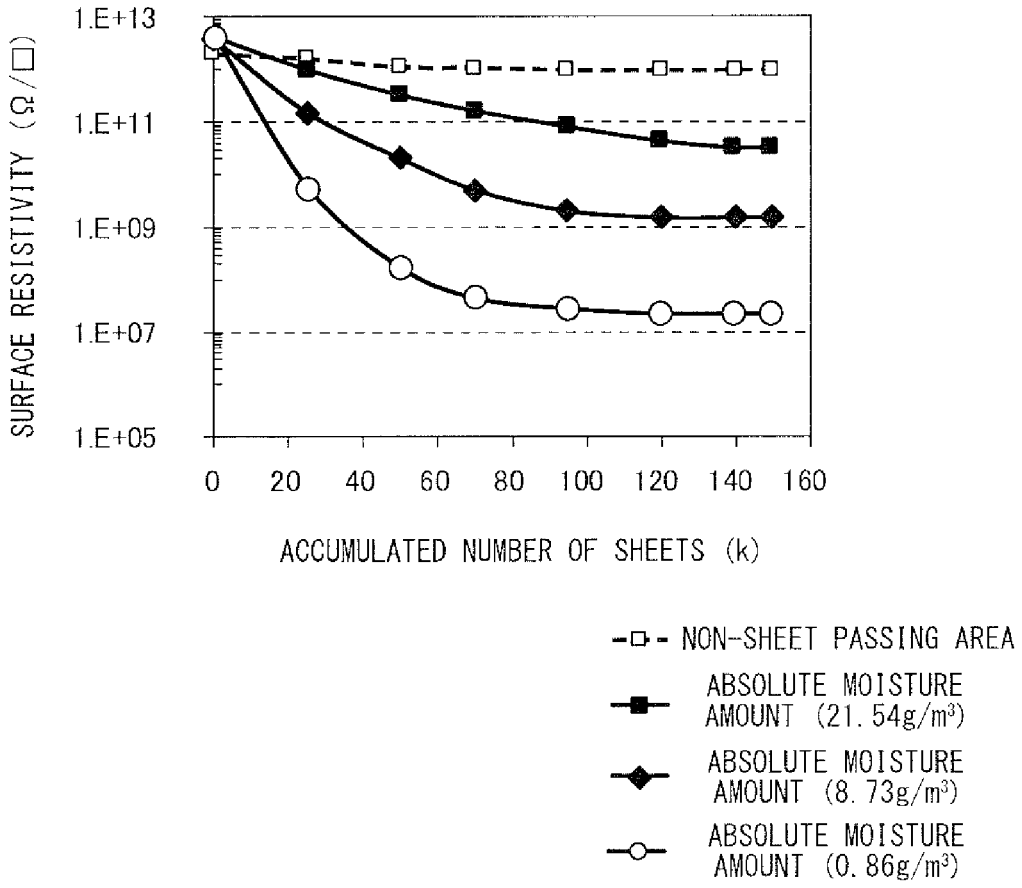
FIG. 6 is a graph illustrating a relationship between accumulated number of sheets and surface resistivity of belt corresponding to absolute moisture amount.

It has been confirmed by experiments carried out by the present inventors that the above-mentioned reduction of surface resistivity of the intermediate transfer belt 8 depends on the environment in which the image forming apparatus 100 is placed, especially the humidity. FIG. 6 is a graph illustrating the relationship between the accumulated number of sheets of the recording material S and the surface resistivity of the intermediate transfer belt 8 according to respective absolute moisture amounts, i.e., humidity, after continuously forming images to vertically conveyed A4-sized sheets, i.e., A4 vertical, as the recording material S. In FIG. 6, the solid line represents the surface resistivity of the sheet passing area, and the dotted line represents the surface resistivity of the non-sheet passing area. In the present embodiment, surface resistivities of the sheet passing area were divided into cases where the respective absolute moisture amounts according to humidity were "0.86 g/m$^3$, 8.73 g/m$^3$, and 21.54 g/m$^3$".

As illustrated in FIG. 6, as the absolute moisture amount reduces, that is, as humidity drops, it can be recognized that the surface resistivity of the intermediate transfer belt 8 reduces. In an environment where the absolute moisture amount is low, the amount of moisture contained in the recording material S is low, so that the electric resistance of the recording material S becomes high, and according thereto, the secondary transfer voltage is set high. That is, power supply E2 applies, as secondary transfer voltage, a first transfer voltage in a case where the humidity is a first humidity, and a second transfer voltage that is higher than the first transfer voltage in a case where the humidity is a second humidity that is lower than the first humidity. As the secondary transfer voltage increases, the amount of discharge that occurs between the recording material S and the intermediate transfer belt 8 when the recording material S passes the secondary transfer portion T2 increases, and thereafter, the surface resistivity of the sheet passing area of the intermediate transfer belt 8 reduces greatly. Especially in a relatively dry environment where the absolute moisture amount is approximately "0.86 g/m$^3$", the difference between the surface resistivity of the sheet passing area and the surface resistivity of the non-sheet passing area becomes greater than one digit when the accumulated number of sheets of the recording material S is approximately "16 k". That is, image defects are caused by the reduction of surface resistivity of the intermediate transfer belt 8.

According to the first embodiment described above, an example where the replacement of the intermediate transfer belt 8 is notified simply based on the accumulated number of sheets of the small-sized recording material S has been described (refer to S4 to S7 of FIG. 5). However, the size of the recording material S is not simply divided into two sizes, the small-sized recording material S and a recording material S having a size other than the small size, and the division between the sheet passing area and the non-sheet passing area on the intermediate transfer belt 8 may be varied according to the different sizes of the recording material S. In that case, if the recording material S is simply divided into a small size and a size other than the small size and notification of belt replacement is output based on the accumulated number of sheets of the small-sized recording material S, the notification timing may be delayed.

Figure 7:
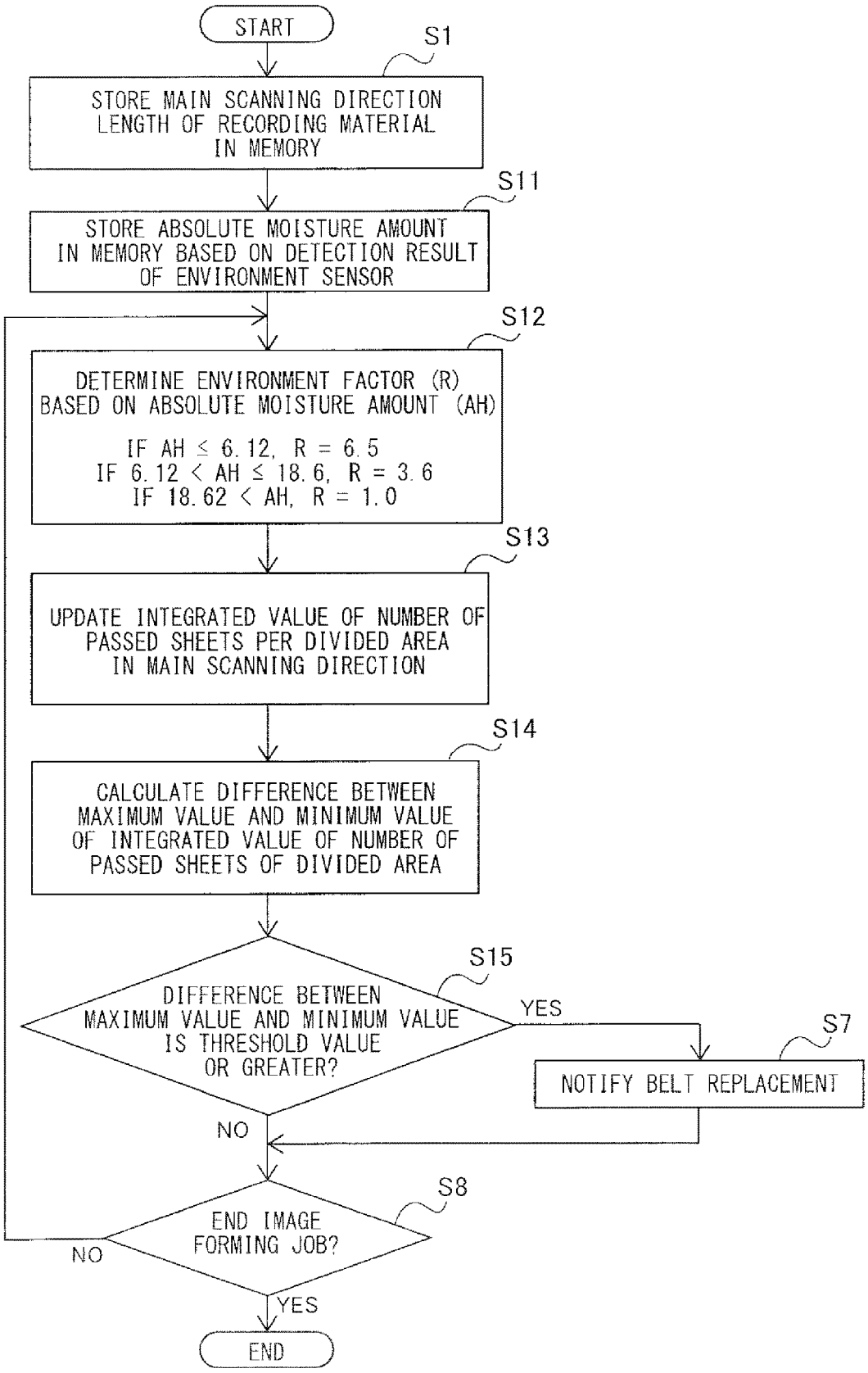
FIG. 7 is a flowchart illustrating a replacement notification processing according to a second embodiment.

Therefore, according to a second embodiment described hereafter, belt replacement is notified by taking into consideration the influence of surface resistivity of the intermediate transfer belt 8 by humidity and the influence of the surface resistivity of the intermediate transfer belt 8 caused by the difference in dividing the sheet passing area and the non-sheet passing area according to the various sizes of the recording material S. Now, a replacement notification processing according to a second embodiment will be described based on FIG. 7 with reference to FIG. 3. FIG. 7 is a flowchart illustrating a replacement notification processing according to a second embodiment. According to the second embodiment illustrated in FIG. 7, processes similar to the replacement notification processing according to the first embodiment illustrated in FIG. 5 are denoted with the same reference numbers, and the processes thereof will only be briefly described.

As illustrated in FIG. 7, the control unit 300 stores the main scanning direction length of the recording material S in the memory 302 (S1). Thereafter, the control unit 300 calculates an absolute moisture amount according to humidity based on the detection result of the environment sensor 20 and stores the absolute moisture amount in the memory 302 (S11). The control unit 300 sets up an environment factor based on the stored absolute moisture amount (S12). For example, if the absolute moisture amount is equal to or smaller than "6.12 g/m$^3$", the environment factor is set to "6.5", if the absolute moisture amount is greater than "6.12 g/m$^3$" and equal to or smaller than "18.6 g/m$^3$", the environment factor is set to "3.6", and if the absolute moisture amount is greater than "18.62 g/m$^3$", the environment factor is set to "1.0".

The control unit 300 counts a count value of number of passed sheets each time image is formed to one sheet of recording material S, and updates an integrated value of number of passed sheets per divided area determined by dividing the intermediate transfer belt 8 into a plurality of determined widths in the width direction, i.e., main scanning direction of the recording material S, according to Expression 1 shown below. In the present embodiment, the count value of number of passed sheets is multiplied by an environment factor, to thereby add the influence of surface resistivity of the intermediate transfer belt 8 caused by humidity. The integrated value of number of passed sheets is information correlated with the number of passed sheets.

Integrated value of number of passed sheets=Integrated value of number of passed sheets prior to update+"count value of number of passed sheets×environment factor" Expression 1

One example of the divided areas is shown in Table 1. According to the present embodiment, the recording material S is conveyed, so-called center-referenced conveyance, so that the center of the intermediate transfer belt 8 approximately corresponds to the center of the recording material S with respect to the width direction of the intermediate transfer belt 8. In Table 1, the size of the divided area is indicated by length (A) in a main scanning direction with a center of the intermediate transfer belt 8 in the width direction set as reference and extending toward both end portions in the width direction. For example, a divided area F1 refers to an area which extends for 90 mm from the center of the intermediate transfer belt 8 in the width direction serving as reference to both end portions, which has a total width of 180 mm A divided area F2 refers to an area which is determined by excluding the divided area F1 from an area which extends for a total width of 209 mm from the center of the intermediate transfer belt 8 serving as reference in the width direction.

TABLE 1

| DIVIDED AREA | MAIN SCANNING DIRECTION LENGTH A |
|---|---|
| F1 | A < 180 mm |
| F2 | 180 mm ≤ A < 209 mm |
| F3 | 209 mm ≤ A < 250 mm |
| F4 | 250 mm ≤ A < 285 mm |
| F5 | 285 mm ≤ A < 305 mm |
| F6 | 305 mm ≤ A |

Figure 8:
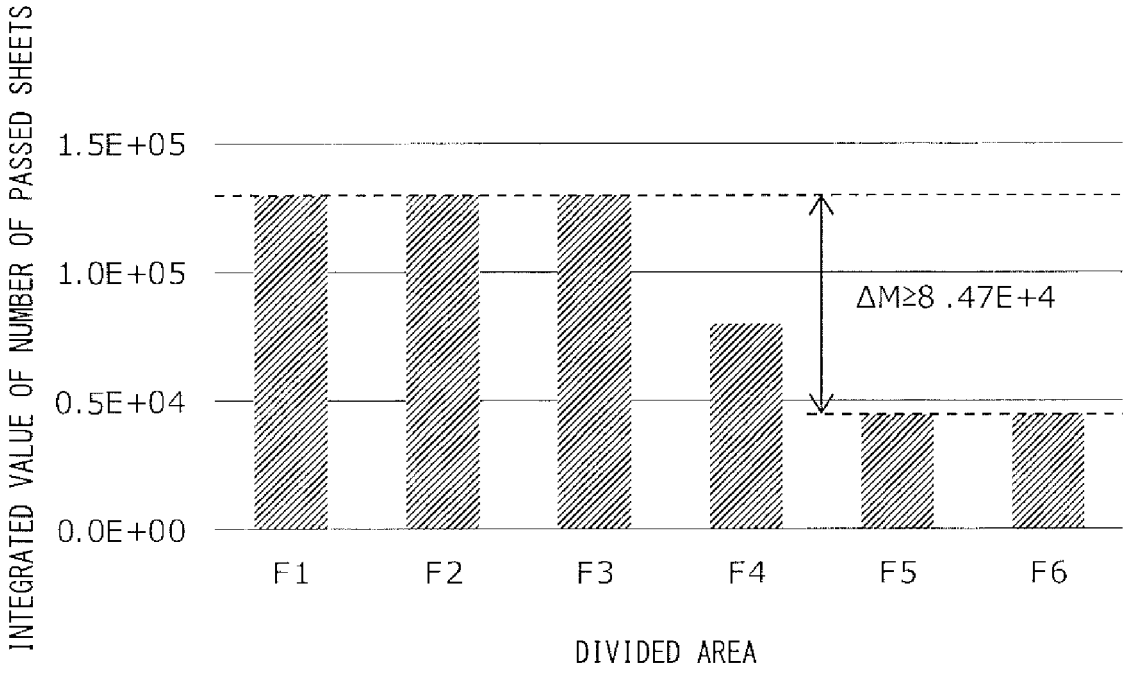
FIG. 8 is a graph illustrating integrated value of number of passed sheets per divided area.

Specifically, in a case where continuous image forming is performed to sheets serving as recording material S which are conveyed in the vertical direction, the integrated value of number of passed sheets of a divided area F6 is updated if the sheet is "SRA3" or greater. The integrated value of number of passed sheets of a divided area F5 is updated if the sheet is "A3" or greater. The integrated value of number of passed sheets of a divided area F4 is updated if the sheet is "B4" or greater. The integrated value of number of passed sheets of a divided area F3 is updated if the sheet is "A4" or greater. The integrated value of number of passed sheets of the divided area F2 is updated if the sheet is "B5" or greater. The integrated value of number of passed sheets of the divided area F1 is updated by all sheet sizes. Since the sheet passing area and the non-sheet passing area differ per each size of the recording material S, and degree of contribution to reduction of surface resistivity of the intermediate transfer belt 8 differs according to the size of the recording material S, so that in consideration thereof, the integrated value of number of passed sheets is calculated per divided area. FIG. 8 illustrates one example of the integrated value of number of passed sheets per divided area. For example, in a case where the humidity is the same, if continuous image forming is performed only to "A4" size sheets, the integrated value of number of passed sheets is incremented in the same manner for the divided areas F1, F2 and F3. Thereafter, if continuous image forming is performed to "B4" size sheets, the integrated value of number of passed sheets is incremented in the same manner for the divided areas F1, F2, F3 and F4 corresponding to the number of sheets. Further, if continuous image forming is performed to "SRA3" size sheets, the integrated value of number of passed sheets is incremented in the same manner for the divided areas F1 to F6 corresponding to the number of sheets. In this case, as illustrated in FIG. 8, the respectively calculated integrated values of number of passed sheets are the same for the divided areas F1 to F3, the value thereof for the divided area F4 is smaller than that of the divided areas F1 to F3, and the values thereof for the divide areas F5 and F6 are the same and smaller than that of the divided area F4.

Returning to FIG. 7, the control unit 300 calculates a difference between the maximum value and the minimum value of the integrated value of number of passed sheets from the integrated values of number of passed sheets per divided area (S14). Then, the control unit 300 determines whether the difference between the maximum value and the minimum value of the integrated value of number of passed sheets is a predetermined difference or greater (for example, 8.47 E+4 or greater) (S15). If the difference between the maximum value and the minimum value of the integrated value of number of passed sheets is a predetermined difference or greater (S15: YES), the control unit 300 notifies the user to replace the belt since the surface resistivity of the belt in the main scanning direction differs so much as to cause image defects (S7). That is, the control unit 300 outputs the error information of the belt based on a maximum value and a minimum value in each value. Thereafter, the control unit 300 proceeds to the processing of step S8. In the present embodiment, if the difference between the maximum value and the minimum value of the integrated value of number of passed sheets that had been calculated for each divided area has become "8.47 E+4" or greater, image defects were caused by the reduction of surface resistivity of the intermediate transfer belt 8. Therefore, the predetermined difference (threshold value) for determining belt replacement is set to "8.47 E+4".

If the difference between the maximum value and the minimum value of the integrated value of number of passed sheets is smaller than a predetermined difference (S15: NO), the control unit 300 determines whether the image forming job has been completed (S8). If the image forming job has been completed (S8: YES), the control unit 300 ends the replacement notification processing. If the image forming job is not completed (S8: NO), the control unit 300 returns to the processing of step S12 and repeats the processes of steps S12 to S8.

In the present description, the belt has been divided into six divided areas F1 to F6, but the present invention is not limited to this example, and the intermediate transfer belt 8 can be divided into a larger number of divided areas. In another example, the intermediate transfer belt 8 can be divided into two divided areas, which are a center area and an end area. In that case, in a state where the recording material S passes the secondary transfer portion T2 in a state where secondary transfer voltage is applied, a first number of passed sheets of the recording material S that had passed only the center area and a second number of passed sheets of the recording material S that had passed the end area including the center area are counted. Then, if the difference between the first number of passed sheets and the second number of passed sheets is a predetermined difference or greater, the replacement of the intermediate transfer belt 8 is notified. Further according to the present embodiment, the integrated value of number of passed sheets has been used as information correlated with the number of passed sheets/value about the number of recording materials respectively passing through the divided area of the belt, but the present invention is not limited thereto. For example, the integrated value of passing time that the recording material S takes to pass the secondary transfer portion T2 or the integrated value of travelling distance of the intermediate transfer belt 8 for the recording material S to pass the secondary transfer portion T2 can be used.

As described, according to the present embodiment, the number of passed sheets of the recording material S that had passed the secondary transfer portion T2 along with the execution of the image forming job has been counted for each of the plurality of divided areas dividing the intermediate transfer belt 8 in the width direction, and replacement of the belt can be notified based on the number of passed sheets per divided area. That is, the control unit 300 serves as an acquisition unit configured to acquire values about the number of recording materials respectively passing through divided areas of the belt, the divided areas being areas of the belt divided in a width direction of the belt in the transfer nip portion. In other words, the control unit 300 serves as an acquisition unit configured to divide the transfer nip portion T2 into a plurality of divided areas in a width direction intersecting a rotation direction of the belt 8, and acquire each value correlated with the number of sheets of recording material passing through each divided area. Further, it can be said that the control unit 300 is configured to acquire each value related to the number of recording materials passing through each area of the belt divided into a plurality of areas in a width direction of the belt. Also, the control unit 300 serves as the output unit configured to output error information related to a life of the belt 8 based on the values acquired by the acquisition unit. Thereby, even if a variety of recording materials S having different sizes are used, the replacement of the intermediate transfer belt 8 can be notified to the user before image defects caused by reduction of surface resistivity of the intermediate transfer belt 8 caused by contact with the recording material S occur.

Third Embodiment

As described, the reduction of surface resistivity of the intermediate transfer belt 8 is caused by generation of micro discharge between the charged recording material S and the intermediate transfer belt 8. The discharge current of micro discharges caused between the recording material S and the intermediate transfer belt 8 differs, in addition to the environment in which the image forming apparatus 100 is placed, specifically humidity, based on whether the printing is performed to a first side or a second side in the duplex printing mode, or whether the printing is performed by a full-color mode or a mono-color mode. Specifically, discharge current becomes higher when printing on the second side than the first side, and when performing the full-color mode than the mono-color mode. That is, if printing is to be performed on the second side, the amount of moisture contained in the recording material S is reduced by being heated by the fixing unit 30 when fixing the toner image on the first side, and the electric resistance of the recording material S is increased, so that a higher secondary transfer voltage is applied. In the case of full-color printing, the electric resistance is increased by superposing a plurality of colored toners, so that a higher secondary transfer voltage is applied. By having a high secondary transfer voltage applied as described, the above-mentioned discharge current of micro discharge that occurs between the recording material S and the intermediate transfer belt 8 may be increased.

Figure 9:
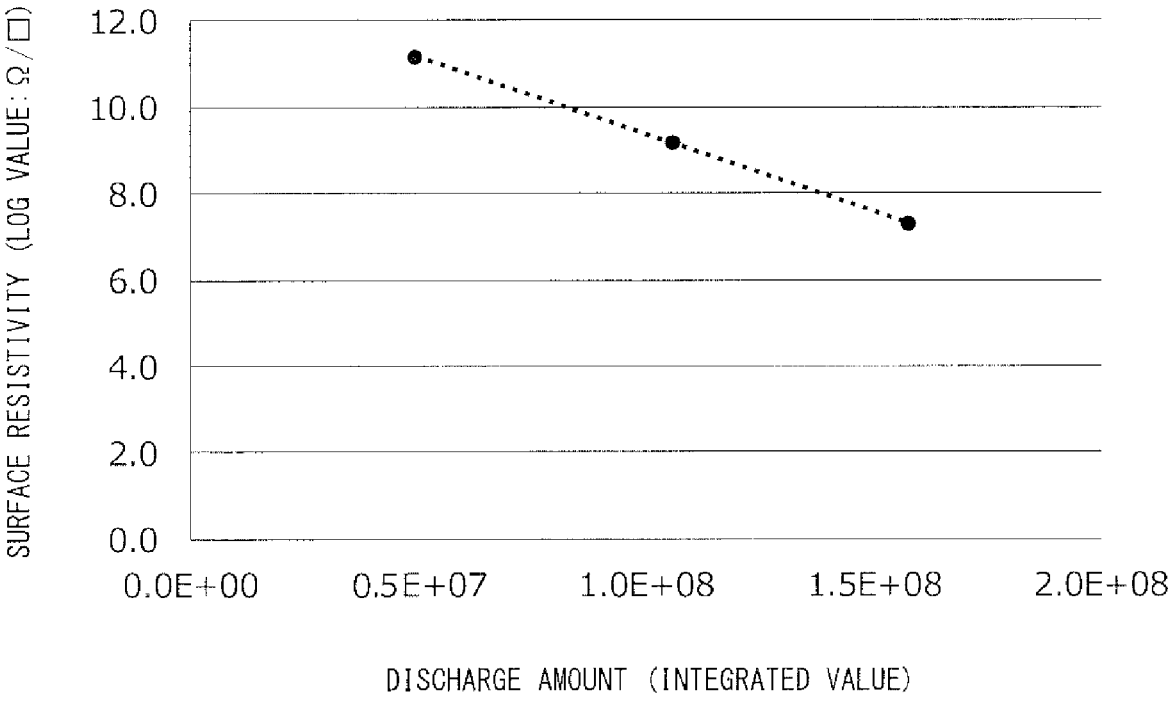
FIG. 9 is a graph illustrating a relationship between integrated value of discharge amount and surface resistivity of belt.

FIG. 9 illustrates a relationship between the amount of discharge, i.e., integrated value, and the surface resistivity of the intermediate transfer belt 8. As illustrated in FIG. 9, as the amount of discharge, i.e., integrated value, increases, the reduction of surface resistivity of the intermediate transfer belt 8 is also increased.

Figure 10:
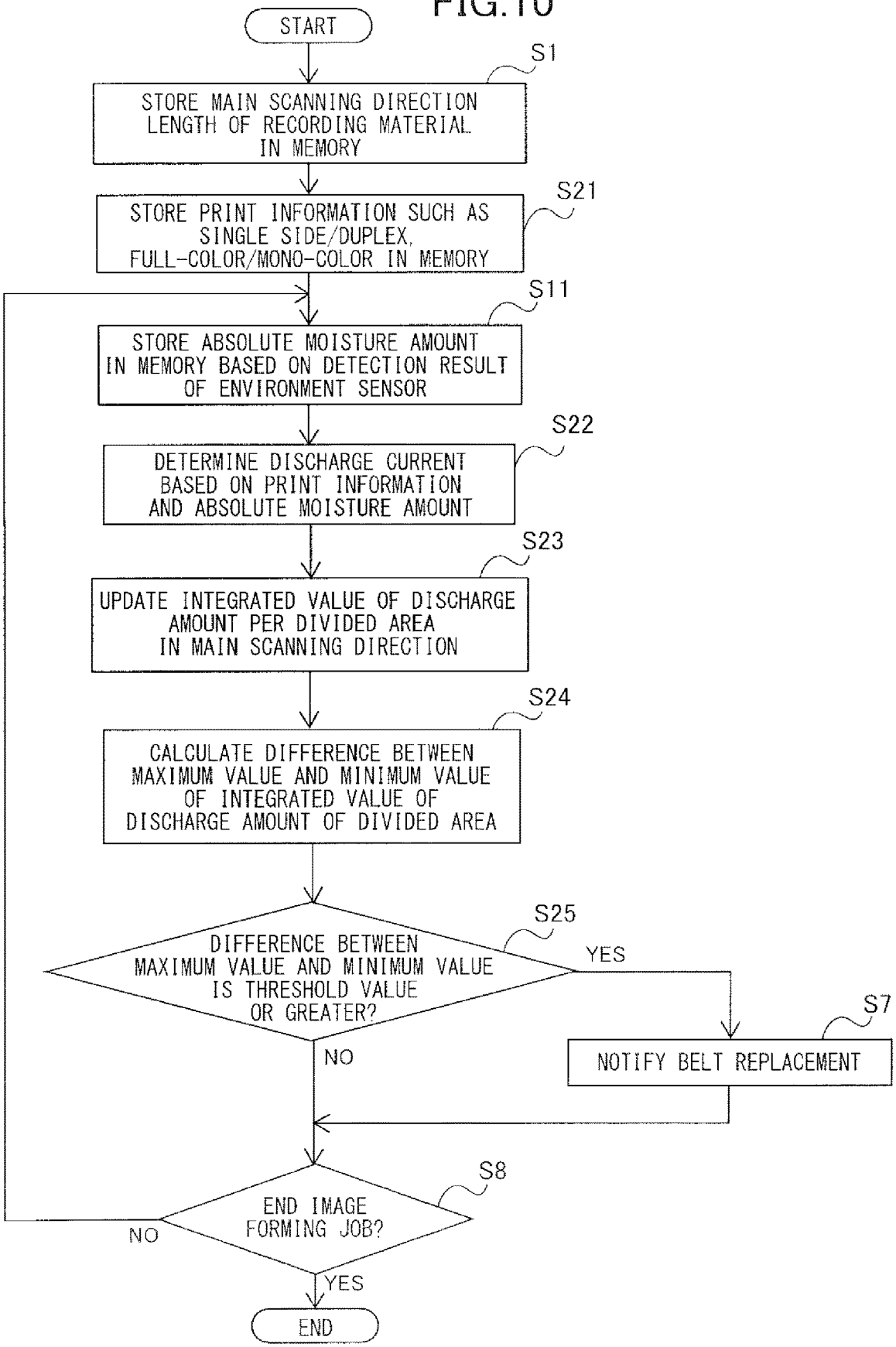
FIG. 10 is a flowchart illustrating a replacement notification processing according to a third embodiment.

Therefore, according to the third embodiment described below, replacement of belt can be notified by considering the influence of surface resistivity of the intermediate transfer belt 8 by humidity, and the influence of surface resistivity of the intermediate transfer belt 8 caused by the amount of discharge caused by micro discharge that occurs between the recording material S and the intermediate transfer belt 8. A replacement notification processing according to the third embodiment will be described based on FIG. 10 with reference to FIG. 3. FIG. 10 is a flowchart illustrating the replacement notification processing according to the third embodiment. According to the third embodiment illustrated in FIG. 10, processes similar to the replacement notification processing of the second embodiment illustrated in FIG. 7 are denoted with the same reference numbers, and the processes thereof will only be described briefly.

As illustrated in FIG. 10, the control unit 300 stores the main scanning direction length of the recording material S in the memory 302 (S1). Further, the control unit 300 stores whether the printing mode entered through the operation unit 200 is a one-side printing mode or a duplex printing mode and whether it is a mono-color mode or a full-color mode as print information in the memory 302 (S21). Further, the control unit 300 calculates the absolute moisture amount according to humidity based on the detection result of the environment sensor 20, and stores the absolute moisture amount as environmental information in the memory 302 (S11).

Then, the control unit 300 refers to a discharge current conversion table shown in Table 2 based on the print information and the environmental information stored in the memory 302 and calculates the discharge current (S22). As illustrated in Table 2, the discharge current (unit: μA) is greater if the absolute moisture amount is lower. If the absolute moisture amount is the same, the discharge current is greater if the mode is a full-color mode than the mono-color mode. Further, if the absolute moisture amount is the same, the discharge current is greater for the second side than the first side.

TABLE 2

| | HUMIDITY OF INSTALLATION ENVIRONMENT (MOISTURE AMOUNT: g/m³) | | | | | | | | | | | |
|---|---|---|---|---|---|---|---|---|---|---|---|---|
| | LOWER THAN 3.5 g/m³ | | | | 3.5 g/m³ OR GREATER AND LOWER THAN 12.2 g/m³ FULL-COLOR OR MONO-COLOR | | | | 12.2 g/m³ OR GREATER | | | |
| | FULL-COLOR | | MONO-COLOR | | FULL-COLOR | | MONO-COLOR | | FULL-COLOR | | MONO-COLOR | |
| | 1st SIDE OR 2nd SIDE | | | | | | | | | | | |
| PRINTING MODE | 1st SIDE | 2nd SIDE | 1st SIDE | 2nd SIDE | 1st SIDE | 2nd SIDE | 1st SIDE | 2nd SIDE | 1st SIDE | 2nd SIDE | 1st SIDE | 2nd SIDE |
| DISCHARGE CURRENT (μA) | 7.5 | 10.7 | 4.1 | 7.0 | 4.8 | 6.0 | 1.0 | 1.4 | 1.4 | 1.8 | 1.3 | 1.7 |

Regarding the discharge current conversion table illustrated in Table 2, a plurality of such tables can be stored in the memory 302 according to the size, or area, of the secondary transfer voltage. In that case, the discharge current in the discharge current conversion table is higher if the second transfer voltage is higher. Further, a plurality of the discharge current conversion tables illustrated in Table 2 can be stored in the memory 302 according to the sheet thickness of the recording material S, more specifically, the level or range of grammage of the recording material S. That is, if the grammage of the recording material S is a first grammage, the first transfer voltage is applied, and if the grammage of the recording material S is a second grammage that is greater than the first grammage, a second transfer voltage higher than the first transfer voltage is applied. Therefore, as the grammage of the recording material S increases, the discharge current of the discharge current conversion table increases.

The control unit 300 multiplies the discharge current obtained by referring to the discharge current conversion table with the passing distance, i.e., conveyance direction length, of the recording material S for each of the divided areas F1 to F6, and updates an integrated value of discharge amount as information correlated with the number of passed sheets (S23).

Integrated value of discharge amount=Integrated value of discharge amount prior to update+"discharge current×passing distance" (amount of discharge) per recording material — Expression 2

The control unit 300 calculates the difference between the maximum value and the minimum value of the integrated value of discharge amount per integrated value of discharge amounts of the respective divided areas (S24). Then, the control unit 300 determines whether the difference between the maximum value and the minimum value of the integrated value of discharge amount is a predetermined threshold value (for example, 2.8 E+7) or greater (S25). If the difference between the maximum value and the minimum value of the integrated value of discharge amount is equal to or greater than the predetermined threshold value (S25: YES), the control unit 300 notifies the user to replace the belt since the difference in the surface resistivity of the belt in the main scanning direction is so great that image defects may be caused (S7). That is, the control unit 300 outputs the error information of the belt based on each value related to the number of recording materials passing through each area of the belt and the transfer voltage corresponding to the recording material passing through each area. Thereafter, the control unit 300 advances to the processing of step S8. In the case of the present embodiment, image defects were caused by the reduction of surface resistivity of the intermediate transfer belt 8 if the difference between the maximum value and the minimum value of the integrated value of discharge amount calculated per divided area becomes "2.8 E+7" or greater. Therefore, the threshold value for determining belt replacement is set to "2.8 E+7".

If the difference between the maximum value and the minimum value of the integrated value of discharge amount is smaller than the predetermined threshold value (S25: NO), the control unit 300 determines whether the image forming job has been completed (S8). If the image forming job has been completed (S8: YES), the control unit 300 ends the replacement notification processing. If the image forming job has not been completed (S8: NO), the control unit 300 returns to the processing of step S11 and repeats the processing of steps S11 to S25, S7 and S8 again.

As described, according to the present embodiment, belt replacement can be notified by considering the environment in which the image forming apparatus 100 is placed, the single-side/duplex printing mode, the full-color/mono-color mode, the grammage of the recording material S and the like that influence the reduction of surface resistivity of the intermediate transfer belt 8. Thereby, the reduction of surface resistivity of the intermediate transfer belt 8 that occurs by contact with the recording material S can be predicted with high accuracy, and belt replacement can be notified to the user more reliably before image defects caused by reduction of surface resistivity of the intermediate transfer belt 8 occur. In the present embodiment, the integrated value of discharge amount is updated based on "discharge current× passing distance" per recording material, but it is also possible to use the count value of the number of passed sheets as in the first embodiment described earlier.

Other Embodiments

The above-described embodiments described an image forming apparatus adopting a configuration where toner images of respective colors are primarily transferred from the photosensitive drums 1Y to 1K corresponding to the respective colors to the intermediate transfer belt 8, and thereafter, the combined toner image of multiple colors is collectively secondarily transferred to the recording material S, but the present invention is not limited thereto. For example, an image forming apparatus adopting a direct transfer system can be used where the toner images on the photosensitive drums are directly transferred to a recording material conveyed on a conveyor belt to which a nip portion had been formed with the photosensitive drum by applying transfer voltage to a transfer roller arranged to oppose to the photosensitive drum with the conveyor belt interposed therebetween.

According to the present invention, it becomes possible to notify replacement of the belt to the user easily before image defects are caused when forming image on a recording material having a large size due to the level difference of surface resistivities in the width direction of the belt that occurs after transferring images to small-sized recording materials.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-246430, filed Dec. 28, 2018, which is hereby incorporated by reference herein in its entirety.

What is claimed is:

1. An image forming apparatus comprising:

an endless belt configured to rotate and bear a toner image;

a rotary member configured to transfer the toner image on the belt to a recording material;

a power supply configured to apply transfer voltage to the rotary member to transfer the toner image on the belt to the recording material;

an acquisition unit configured to acquire each value related to the number of recording materials passing through each area of the belt divided into a plurality of areas in a width direction of the belt; and an output unit configured to output error information related to a life of the belt based on each value.

2. The image forming apparatus according to claim 1, wherein the output unit is configured to output the error information of the belt based on a maximum value and a minimum value in each value.

3. The image forming apparatus according to claim 1, wherein the output unit is configured to output the error information of the belt based on each value and the transfer voltage corresponding to the recording material passing through each area.

4. The image forming apparatus according to claim 1, further comprising an environment sensor configured to detect environmental information, wherein the output unit is configured to output the error information of the belt based on each value and the environmental information corresponding to the recording material passing through each area.

5. The image forming apparatus according to claim 1, wherein the acquisition unit is configured to acquire each value based on print information.

6. The image forming apparatus according to claim 1, wherein the acquisition unit is configured to acquire each value based on a length in a conveyance direction of the recording material passing through each area.

7. The image forming apparatus according to claim 1, wherein the error information is information notifying to replace the belt.

8. The image forming apparatus according to claim 1, further comprising a notification unit configured to notify of replacement of the belt based on the error information.

9. An image forming apparatus comprising:

an endless belt configured to rotate and bear a toner image;

a rotary member configured to transfer the toner image on the belt to a recording material at a transfer nip portion;

a power supply configured to apply transfer voltage to transfer the toner image on the belt to the recording material; and an output unit configured to output error information related to a life of the belt based on a size in a width direction of the recording material passing through the transfer nip portion and a value related to the number of recording materials passing through the transfer nip portion, wherein in a case that images are continuously formed on a plurality of first recording materials having a maximum size in the width direction of the belt, the output unit outputs the error information of the belt when the number of recording materials passing through the transfer nip portion reaches a first number, and in case that images are continuously formed on a plurality of a second recording materials having a predetermined size smaller than the maximum size in the width direction, the output unit outputs the error information of the belt when the number of recording materials passing through the transfer nip portion reaches a second number smaller than the first number.

* * * * *